US008607747B2

(12) United States Patent
Herrmann

(10) Patent No.: US 8,607,747 B2
(45) Date of Patent: Dec. 17, 2013

(54) CYLINDER HEAD HOUSING FOR AN INTERNAL COMBUSTION ENGINE

(75) Inventor: Hartmut Herrmann, Mainz (DE)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/421,974

(22) Filed: Mar. 16, 2012

(65) Prior Publication Data

US 2012/0234276 A1 Sep. 20, 2012

(30) Foreign Application Priority Data

Mar. 18, 2011 (DE) ..... 10 2011 014 335

(51) Int. Cl.
*F01L 1/00* (2006.01)

(52) U.S. Cl.
USPC ..... 123/90.1; 277/590

(58) Field of Classification Search
USPC ..... 123/90.1; 277/590–595
See application file for complete search history.

(56) References Cited

U.S. PATENT DOCUMENTS 6,035,817 A * 3/2000 Uchida ..... 123/90.17
7,235,286 B2 * 6/2007 Salameh ..... 428/139
7,594,488 B2 * 9/2009 Yoshijima et al. ..... 123/90.38
7,815,198 B2 * 10/2010 Tani ..... 277/644
2011/0041790 A1 2/2011 Ilgeroth et al.

FOREIGN PATENT DOCUMENTS

| | | | |
|---|---|---|---|
| DE | 19844217 | C1 | 4/2000 |
| DE | 102008007091 | A1 | 8/2009 |
| FR | 2526864 | A1 | 11/1983 |
| JP | H0687649 | U | 12/1994 |
| JP | 7042614 | A | 2/1995 |
| JP | 2006322481 | A | 11/2006 |

OTHER PUBLICATIONS

German Patent Office, German Search Report for Application No. 102011014335.1, dated Jan. 16, 2012.

* cited by examiner

*Primary Examiner* — Zelalem Eshete
(74) *Attorney, Agent, or Firm* — Ingrassia Fisher & Lorenz, P.C.

(57) ABSTRACT

A cylinder head cover is provided for an internal combustion engine having a cover sealing surface for a seal. The seal seals a level cylinder head sealing surface of a cylinder head housing and a curved bearing cap sealing surface of a common frontal bearing cap in relation to frontally arranged camshaft bearings. The curved bearing cap sealing surface of the frontal bearing cap has an outer contour having a middle part above the cylinder head sealing surface and having two transition areas, which slope down diagonally from the cylinder head sealing surface and are skewed in relation to the middle part.

13 Claims, 3 Drawing Sheets

CYLINDER HEAD HOUSING FOR AN INTERNAL COMBUSTION ENGINE

CROSS-REFERENCE TO RELATED APPLICATION

This application claims priority to German Patent Application No. 10 2011 014 335.1, filed Mar. 18, 2011, which is incorporated herein by reference in its entirety.

TECHNICAL FIELD

The technical field relates to a cylinder head housing for an internal combustion engine having a sealing surface for a seal, and more particularly to the seal on the sealing surface that seals a cylinder head housing having a frontally arranged bearing cap in relation to camshaft bearings.

BACKGROUND

A cylinder head cover seal is known for this purpose from DE 198 44 217 C1, which seals a cylinder head cover on a cylinder head housing using at least one sealing section extending in a sealing plane, which is adjoined by a sealing area protruding from the sealing plane. A transition zone is implemented between the sealing section and the sealing area, in which the shape of the sealing section and the shape of the sealing area merge into one another. In order to improve the installation capability of such a cylinder head cover seal, a stabilization device is provided, which cooperate with the transition zone and stabilize its form. The stabilization device has adhesive or adhesive compounds.

Known stabilization device are solely installation aids and assist critical seal areas, which do not have a level sealing surface, during the installation of seals. It must be accepted that the adhesive or the adhesive compounds which are used as the installation aid and stabilization device do not permit reuse of the cylinder head cover seal. In addition, the known stabilization device do not assist a long-lived seal between a cylinder head cover made of plastic and a cylinder head housing made of metal alloys, in particular if the seal is to seal sealing surfaces of the cylinder head cover made of plastic having transitions at the frontal bearing cap to level sealing surfaces of the cylinder head housing.

Even if the cylinder head cover is designed very carefully, so that a suitable sealing profile of a seal can be pressed on everywhere between sealing surfaces of the cylinder head cover and sealing surfaces of the frontal bearing cap as well as level sealing surfaces of the cylinder head housing, the plastic of the cylinder head cover does not form a very robust material with respect to aging, stiffness, and temperatures, which can certainly reach levels greater than approximately 150° C. on the cylinder head housing. The plastic of the cylinder head cover ages due to the temperature cycles of an internal combustion engine, so that the compression of the seal diminishes in particular at the transitions from the cylinder head housing to the frontal bearing cap and leaks can occur for a spray oil mist.

Even with the use of a common bearing cap, which accommodates the frontal camshaft bearings of two adjacent camshafts, the problem of the transition between the level sealing surface of the cylinder head housing to the frontal bearing cap is merely displaced to the outer sides of the common bearing cap and does not assist reliable and reproducible installation of a cylinder head cover seal in these critical transition areas, in particular not in the event of multiple openings of the cylinder head cover for inspection, maintenance, or overhaul work.

In view of the foregoing, at least one object is to achieve an improvement for a long-lived seal and an ability to install a seal multiple times between cylinder head cover and cylinder head housing in the area of a frontal bearing cap. In addition, other objects, desirable features and characteristics will become apparent from the subsequent summary and detailed description, and the appended claims, taken in conjunction with the accompanying drawings and this background.

SUMMARY

An embodiment of a cylinder head cover is provided for an internal combustion engine having a cover sealing surface for a seal. The seal seals off a level cylinder head sealing surface of a cylinder head housing and a curved bearing cap sealing surface of a common frontal bearing cap in relation to frontally arranged camshaft bearings. The curved bearing cap sealing surface of the frontal bearing cap has an outer contour having a middle part above the cylinder head sealing surface and two transition areas, which slope down diagonally toward the cylinder head sealing surface and are skewed in relation to the middle part, the cylinder head cover having its cover sealing surface being adapted to the level cylinder head sealing surface and the curved bearing cap sealing surface even in the skewed transition areas.

Using this head sealing surface, which is adapted to the curved bearing cap sealing surface having a middle part and having two transition areas skewed in relation to the middle part, traction and compression forces which occur horizontally and transversely to the camshaft axes of the camshafts guided in the camshaft bearings are introduced into the structure of the cylinder head cover with less strain. For this purpose, an outer contour of the common bearing cap is provided, which has a locally skewed sealing surface both on the cylinder head cover and also on the frontal bearing cap. The horizontal compression force is thus distributed in the two transition areas, which slope down diagonally to the level cylinder head sealing surface and are skewed in relation to the middle part, between bearing cap and cylinder head housing in the transverse and longitudinal directions to the camshaft axis. The transverse forces, which are a cause for leaks, can be reduced by the degree of the pivoting of the transition areas, which slope down diagonally to the level cylinder head sealing surfaces and are skewed in relation to the middle part, of the bearing cap, whereby the seal at the angled transitions is advantageously improved and the transverse load of the cylinder head cover is reduced.

However, the forces horizontally and longitudinally to the camshaft axis must now be supported by an additional design measure, as long as a middle part of the bearing cap sealing surface is aligned plane-parallel to the level cylinder head sealing surface. A single adapter sleeve in the middle part of the bearing cap is sufficient for this purpose, because due to the symmetrical design of the transition areas of the sealing surfaces in the area of the frontal common bearing cap, the cylinder head cover can already be sufficiently aligned accordingly during the installation and the force introduction on the seal is equalized.

In a further embodiment, instead of the adapter sleeve, the principle of the skewing can also be applied in amplified form to the sealing surface sections in the area of the middle part of the frontal bearing cap. The skew of the middle part of the bearing cap sealing surface is selected as opposite to the skew in the transition areas, in that the middle part of the bearing cap sealing surface is sunken between the frontal camshaft bearings toward the front side of the cylinder head housing, whereby an opposing force component is achieved horizontally and along the camshaft axis.

Upon the installation of the cylinder head cover on the cylinder head housing, the cylinder head cover covers the access to the camshafts installed on the cylinder head housing. These camshafts are installed inside the cylinder head cover having further semi-cylindrical bearing caps, whose outer contour remains unprocessed after the casting of the bearing caps, from above on the cylinder head housing. Through the interaction of the outer contour of the frontal common bearing cap with the central adapter sleeve for adapting the cylinder head cover screw connection, a centered adapted seat of the cylinder head cover can be achieved. This particularly effective seal of such a frontal bearing cap with the aid of the cylinder head cover is required if control-drive-side ends of the camshafts protrude at the frontal bearing caps between cylinder head cover and cylinder head housing and a spray oil mist from the cylinder head must be prevented from penetrating into the area of these control-drive-side ends.

A cylinder head cover having adapted sealing surface can be produced in a single injection molding process from plastic in spite of the complexity that occurs due to an adaptation to the twisting, beveling, and skewing of the bearing cap sealing surfaces. In order to increase the stiffness and dimensional stability of the cylinder head cover, it is also possible that it is produced from a fiber-reinforced plastic.

In a further embodiment, an elastomeric material, which is rubber-elastic and yielding, can be used as the material of the seal. In addition, the position of the elastomeric material or the seal in relation to the cover sealing surface of the cylinder head cover can be assisted in that a guide groove is provided for a rubber-elastic ring-shaped sealing band. The sealing band has a middle web adapted to the guide groove, which solely holds the rubber-elastic ring-shaped sealing band in the guide groove.

Furthermore, it is provided that the direction and dimension of the skew of the outer contour of the bearing cap for the bearing cap sealing surface are changed on the bearing cap. As already explained above, the middle part at the uppermost point of the bearing cap can be provided as opposite to the skew of the transition areas, whereby twisting of the sealing surfaces and the sealing band between cylinder head cover and frontal bearing cap and cylinder head housing is achieved, so that an adapter sleeve can be entirely omitted during the installation of the cylinder head cover.

The degree of the skew of transition edges of the curved bearing cap sealing surface to the level cylinder head housing sealing surface can also be selected at different dimensions, so that a stronger and larger skew having a greater skew angle can be provided in the area of the transition areas from the bearing cap to the cylinder head housing, in order to increase the horizontal contact pressure in relation to the leak-susceptible transverse forces in this critical area.

In addition, an internal combustion engine is provided with a corresponding cylinder head cover, in order to achieve a reliable separation between the spray oil mist occurring in the cylinder head and the drive-side area of the camshafts. Such an internal combustion engine can advantageously additionally be used in a motor vehicle.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
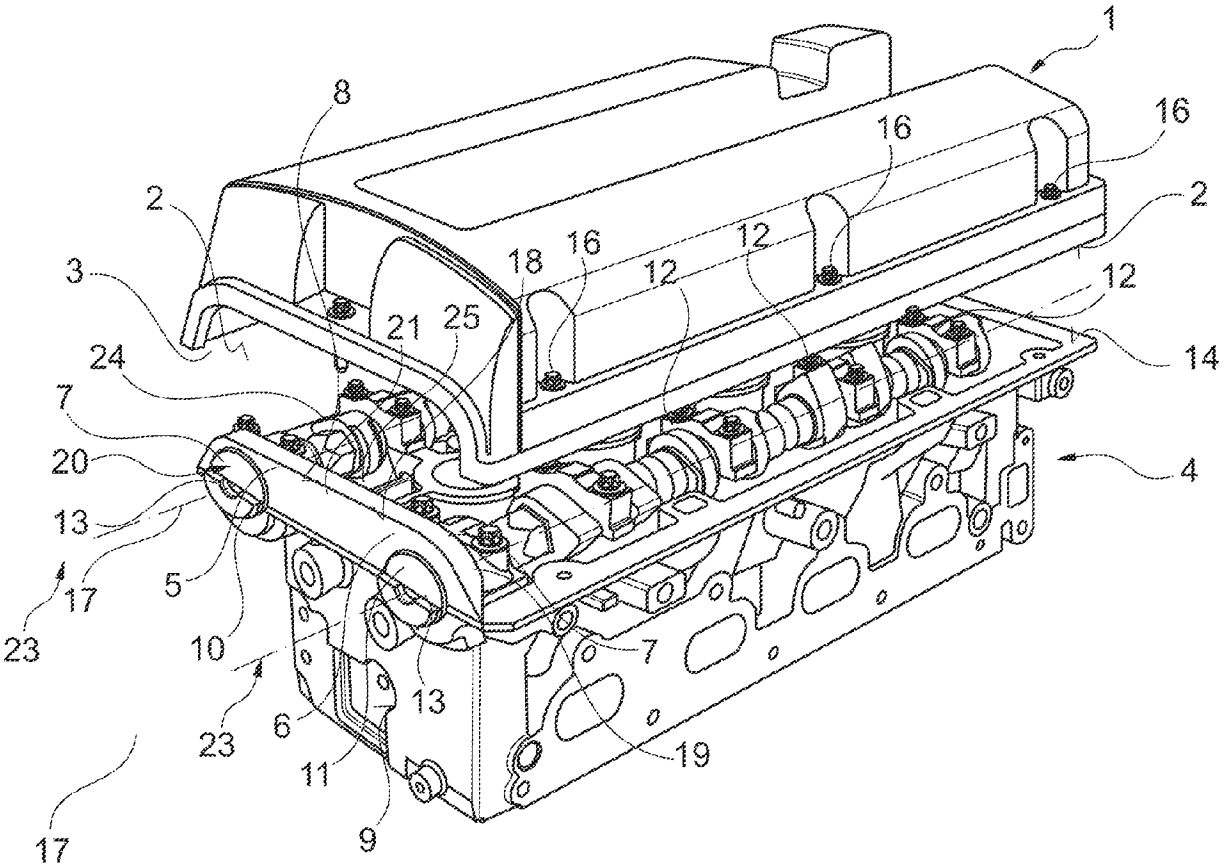
FIG. 1 shows a schematic perspective view of a cylinder head cover over a cylinder head housing according to an embodiment.

FIG. 1 shows a schematic perspective view of a cylinder head cover 1 over a cylinder head housing 4 having two camshafts 10 and 11, which protrude out of a front side 9 of the cylinder head housing 4 with control-drive-side ends 13. The cylinder head cover 1 has a cover sealing surface 2, which cooperates on one side with a level cylinder head sealing surface 14 of the cylinder head housing 4 and, on the front side 9 of the cylinder head housing 4, seals a frontally arranged common bearing cap 5 of the frontal camshaft bearings 6 and 7 in relation to spray oil mist. For this purpose, an elastomeric seal 3 is arranged on the sealing surface 2 of the cylinder head cover 1, which is held in position by a retaining groove (not shown) along the middle of the cover sealing surface 2 during the installation of the cylinder head cover 1.

This seal 3 is also to seal the critical areas in the transition areas 19 and 20 of the frontal bearing cap 5 in relation to the level cylinder head sealing surface 14 of the cylinder head housing 4. The remaining bearing caps 12 for the camshafts 10 and 11, which are arranged below the cylinder head cover 1, can be fixed using an unprocessed outer contour on the cylinder head housing 4. The critical transition areas 19 and 20 will be discussed in greater detail in following FIG. 2 and FIG. 3, in order to show that through suitable design of an outer contour 8 of the frontal bearing cap 5, the two critical transition areas 19 and 20 can be sealed in an improved manner while reducing lateral forces on the cylinder head cover 1. An adapter sleeve 24 in the middle of the common bearing cap 5 cooperates with an adapter hole 25 and ensures that the cylinder head cover 1 is not displaced during an installation of cylinder head screw connections 16.

Figure 2:
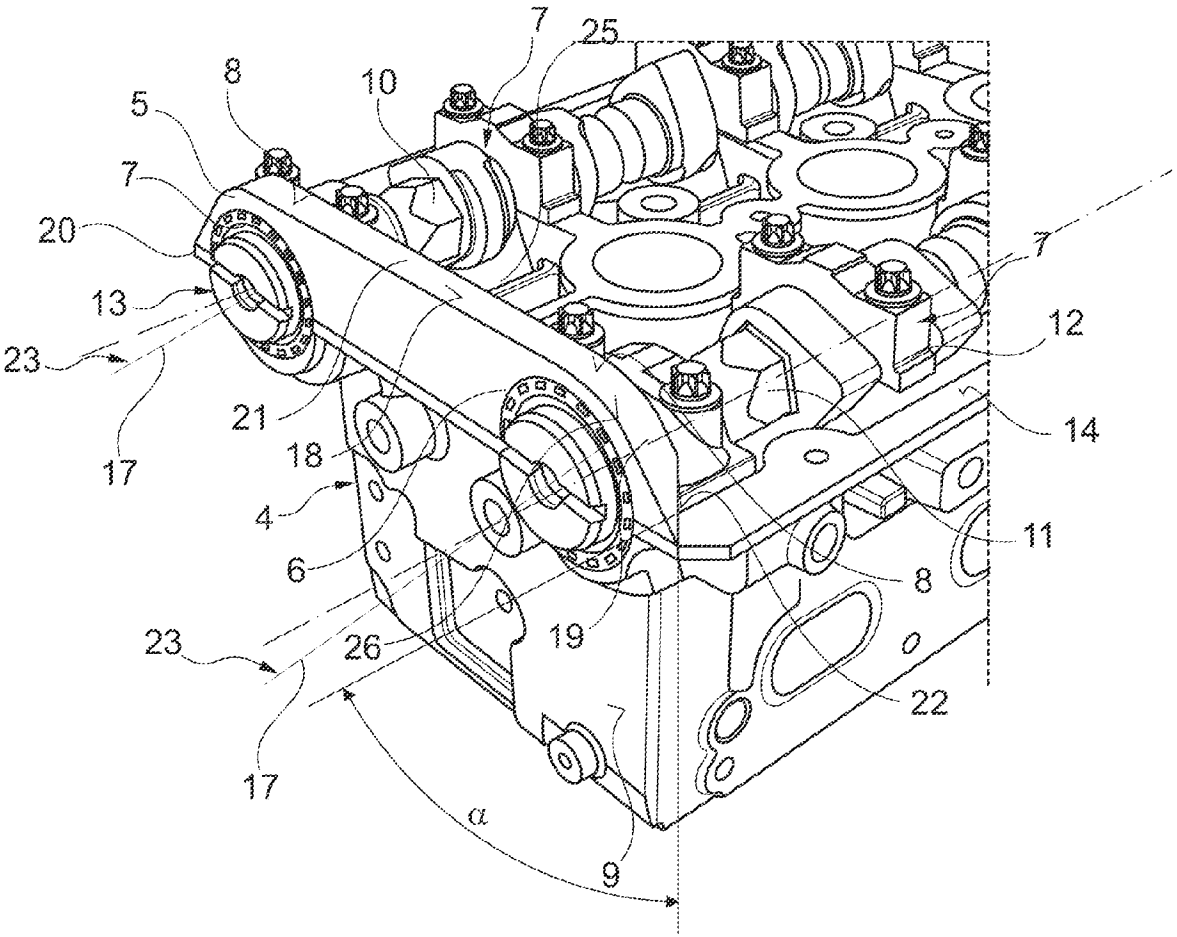
FIG. 2 shows a schematic perspective partial view of the cylinder head housing according to FIG. 1.

FIG. 2 shows a schematic perspective partial view of the cylinder head housing 4 having the common frontally arranged bearing cap 5 according to FIG. 1. This common bearing cap 5 already decreases the four critical transitions from curved bearing cap sealing surfaces for frontal camshaft bearings 6 and 7 to only two critical transition areas to a level cylinder head sealing surface 14. The common bearing cap 5 is provided with a bearing cap sealing surface 18, which has a bevel 26 and a skew by the angle $\alpha$ in the critical transition areas 19 and 20. The transition areas 19 and 20 are therefore skewed in relation to the middle part 21 in such a manner that transition edges 22 of the bearing cap 5 to the cylinder head sealing surface 14 are arranged by the angle $\alpha$ in relation to axes 23 of the camshafts 10 and 11.

The bearing cap sealing surface 18 is provided in the two transition areas 19 and 20 with outer contours 8 in such a manner that sealing pressure forces can occur in the above-mentioned critical areas, which can occur both horizontally and also transversely to the camshaft axes 17 of the camshafts 10 and 11 with mutual support of cylinder head cover and bearing cap 5. In this case, the transition edges 22 have a skew angle α which is greater than 30° in the transition areas 19 and 20 in relation to the middle part 21.

The horizontal pressure force is therefore distributed in the transverse and longitudinal directions to the camshaft axes 17 at the critical transition areas 19 and 20. The transverse forces are considered to be the cause of leaks and can therefore be reduced with the degree of the skew or the dimension of the twisting, where the seal is improved in the transition areas 19 and 20, which can be critical transition areas. In this embodiment of FIG. 2, a middle part 21 of the bearing cap sealing surface 18 is implemented plane-parallel to the level cylinder head sealing surface 14 and only the transition areas 19 and 20 are skewed or twisted in relation to the middle part 21.

During the installation of the cylinder head cover 1 shown in FIG. 1, its cover sealing surface 2 can shift down from the front side 9 in the axial direction of the camshafts 10 and 11. A single central adapter sleeve in cooperation with an adapter hole 25 in the middle area of the common bearing cap 5 is already sufficient to prevent this and to secure the cylinder head screw connections 16, which are shown in FIG. 1, of the cylinder head cover 1 on the cylinder head housing 4.

Figure 3:
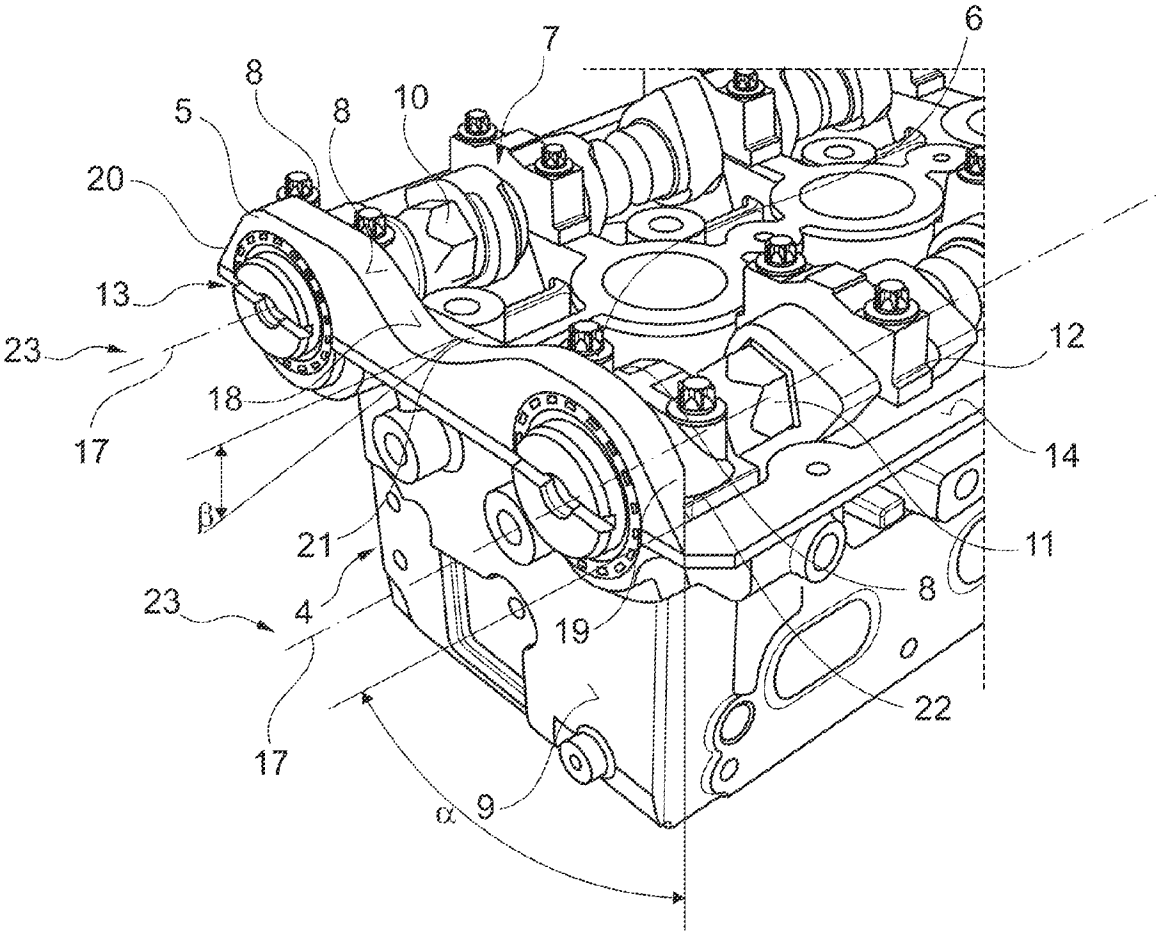
FIG. 3 shows a schematic perspective partial view of the cylinder head housing according to FIG. 1 having altered outer contour of the bearing cap.

FIG. 3 shows a partial view of the cylinder head housing 4 according to FIG. 1 having altered outer contour 8 of the common bearing cap 5. Components having identical functions as in the preceding figures are identified by identical reference numerals and are not explained separately. In contrast to the embodiment of the frontal common bearing cap 5 in FIG. 2, the outer contour 8 is strongly twisted here, because the middle part 21 of the common bearing cap 5 is sunken, opposite to the twist angle α, by the angle 13 in the direction toward the front side 9.

This strong twisting of the outer contour 8 having a change of the twist direction in relation to the skew in the transition areas 19 and 20 of the bearing cap 5 has the advantage that this twisting allows self-centering and self-alignment of the cylinder head bearing cover, so that an additional adapter sleeve can be omitted if this embodiment of the outer contour 8 of the bearing cap 5 is used. Of course, the cylinder head cover must accordingly also have a bulge in this area, so that the cover sealing surface of the cylinder head cover remains adapted to the bearing cap sealing surface 18, which is sunken in the middle part 21.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A cylinder head cover for an internal combustion engine, comprising:

a seal;

a cover sealing surface for the seal that is configured to seal a level cylinder head sealing surface of a cylinder head housing; and a curved bearing cap sealing surface of a common frontal bearing cap in relation to frontally arranged camshaft bearings, wherein the curved bearing cap sealing surface of the common frontal bearing cap has an external contour with a middle part above the cover sealing surface and having two transition areas that slope down diagonally to the cover sealing surface and are skewed in relation to the middle part, wherein the two transition areas are skewed in relation to the middle part in such a manner that transition edges of a curved bearing cap to the cover sealing surface are arranged at angles to axes of the frontally arranged camshaft bearings, and the cover sealing surface is configured accordingly.

2. The cylinder head cover according to claim 1, wherein the middle part of the curved bearing cap sealing surface is level and substantially plane-parallel to the level cylinder head sealing surface.

3. The cylinder head cover according to claim 1, wherein the cylinder head cover comprise a single central adapter sleeve that is configured to adapt the cylinder head cover and an outer contour of a curved bearing cap in cooperation with the single central adapter sleeve, which forms a centered fitted seat of the cylinder head cover on the curved bearing cap.

4. The cylinder head cover according to claim 1, wherein the middle part of the curved bearing cap sealing surface, which is between the frontally arranged camshaft bearings, is sunken toward the front side of the cylinder head housing.

5. The cylinder head cover according to claim 1, wherein the cylinder head cover has a correspondingly bulged area of the cover sealing surface in a middle sunken part of the curved bearing cap sealing surface of the cylinder head housing.

6. The cylinder head cover according to claim 1, wherein control-drive-side ends of camshafts protrude out of the common frontal bearing cap between the cylinder head cover and the cylinder head housing.

7. The cylinder head cover according to claim 5, wherein the cylinder head cover is configured to cover an access to camshafts installed on the cylinder head housing, and the camshafts are installed from above on the cylinder head housing within the cylinder head cover having semi-cylindrical bearing caps.

8. The cylinder head cover according to claim 1, wherein the cylinder head housing is a component comprised of an aluminum alloy.

9. The cylinder head cover according to claim 1, wherein the cylinder head cover is a component formed of an injection plastic molding.

10. The cylinder head cover according to claim 1, wherein the cylinder head cover is a component formed of a fiber-reinforced plastic.

11. The cylinder head cover according to claim 1, wherein an elastomeric material is arranged as the seal between the cover sealing surface of the cylinder head cover, the cylinder head housing, and the common frontal bearing cap.

12. The cylinder head cover according to claim 1, further comprising a guide groove for a rubber-elastic ring-shaped sealing band in the cover sealing surface of the cylinder head cover.

13. The cylinder head cover according to claim 1, wherein the two transition areas are tilted forward relative to the middle part.

* * * * *